US009263016B2

(12) United States Patent
Nakagawa et al.

(10) Patent No.: US 9,263,016 B2
(45) Date of Patent: Feb. 16, 2016

(54) SORTING A PLURALITY OF INPUTTED SOUND GENERATION INSTRUCTIONS TO GENERATE TONES CORRESPONDING TO THE SOUND GENERATION INSTRUCTION IN A SORTED ORDER

(75) Inventors: Mizuki Nakagawa, Hamamatsu (JP); Shun Takai, Hamamatsu (JP)

(73) Assignee: ROLAND CORPORATION, Hamamatsu (JP)

( * ) Notice: Subject to any disclaimer, the term of this patent is extended or adjusted under 35 U.S.C. 154(b) by 340 days.

(21) Appl. No.: 13/403,322

(22) Filed: Feb. 23, 2012

(65) Prior Publication Data

US 2012/0227575 A1 Sep. 13, 2012

(30) Foreign Application Priority Data

Mar. 11, 2011 (JP) ..... 2011-054689

(51) Int. Cl.
*G10H 7/00* (2006.01)
*G10H 1/28* (2006.01)

(52) U.S. Cl.
CPC ..... *G10H 1/28* (2013.01); *G10H 2250/451* (2013.01)

(58) Field of Classification Search
USPC ..... 84/615
See application file for complete search history.

(56) References Cited

U.S. PATENT DOCUMENTS 5,726,374 A * 3/1998 Vandervoort ..... 84/638
5,804,755 A 9/1998 Furukawa
7,420,114 B1 9/2008 Vandervoort
7,528,309 B2 5/2009 Fujiwara
7,728,213 B2 * 6/2010 Stone et al. ..... 84/609
8,017,856 B2 9/2011 Tanaka
2007/0221036 A1 9/2007 Fujiwara
2010/0077908 A1 * 4/2010 Tanaka ..... 84/605

FOREIGN PATENT DOCUMENTS

JP S57093995 12/1980
JP S62294293 12/1987

(Continued)

OTHER PUBLICATIONS

English Abstract and Machine Translation for JPH0981130, published on Mar. 28, 1997, Total 35 pp.

(Continued)

*Primary Examiner* — Christopher Uhlir

(74) *Attorney, Agent, or Firm* — David W. Victor; Konrad Raynes Davda & Victor LLP

(57) ABSTRACT

Provided is an electronic musical instrument comprising: an input device for inputting sound generation instructions of tones at predetermined pitches; a tone generation device that generates tones with predetermined pitches based on sound generation instructions inputted by the input device; a specifying device that specifies a plurality of sound generation instructions inputted by the input device in a predetermined period as a sound generation instruction group; a sorting device that sorts the plurality of sound generation instructions composing the sound generation instruction group specified by the specifying device in a predetermined pitch order; and a control device that controls generation of tones by the tone generation device such that tones corresponding to the sound generation instruction group are generated in the order sorted by the sorting device.

32 Claims, 6 Drawing Sheets

(56) References Cited

FOREIGN PATENT DOCUMENTS

| | | |
|---|---|---|
| JP | H04133100 | 5/1992 |
| JP | H0981130 | 3/1997 |
| JP | 10097243 | 4/1998 |
| JP | 2005316505 | 11/2005 |
| JP | 2007264035 | 10/2007 |
| JP | 2010079179 | 4/2010 |

OTHER PUBLICATIONS

English Abstract and Machine Translation for JP2005316505, published on Nov. 10, 2005, Total 41 pp.
English Abstract for JP2007264035, published Oct. 11, 2007, Total 2 pp.
US Publication No. 2007/0221036, dated Sep. 27, 2007, is an English language equivalent of JP2007264035, dated Oct. 11, 2007.
U.S. Pat. No. 7,528,309, dated May 5, 2009, is an English language equivalent of JP2007264035, dated Oct. 11, 2007.
US Publication No. 2010/0077908, dated Apr. 1, 2010, is an English language equivalent of JP2010079179, dated Apr. 8, 2010, Office Action dated Mar. 13, 2015.
U.S. Pat. No. 8,017,856, dated Sep. 13, 2011, is an English language equivalent of JP2010079179, dated Apr. 8, 2010.
Japanese Office Action, Aug. 12, 2015, for JP2011054689, Total 4 pp.
Machine Translation of Japanese Office Action, Aug. 12, 2015, for JP2011054689, Total 3 pp.
English Abstract for JPH04133100, published on May 7, 1992, Total 2 pp.

* cited by examiner

SORTING A PLURALITY OF INPUTTED SOUND GENERATION INSTRUCTIONS TO GENERATE TONES CORRESPONDING TO THE SOUND GENERATION INSTRUCTION IN A SORTED ORDER

CROSS-REFERENCE TO RELATED FOREIGN APPLICATION

This application is a non-provisional application that claims priority benefits under Title 35, United States Code, Section 119(a)-(d) from Japanese Patent Application entitled "ELECTRONIC KEYBOARD MUSICAL INSTRUMENT" by Mizuki NAKAGAWA and Shun TAKAI, having Japanese Patent Application Serial No. 2011-054689, filed on Mar. 11, 2011, which Japanese Patent Application is incorporated herein by reference in its entirety.

BACKGROUND OF THE INVENTION

1. Field of the Invention

The present invention relates to an electronic musical instrument, including a sound source module, for generating sounds.

2. Description of the Related Art

Electronic musical instruments such as synthesizers and the like can generate tones with various kinds of tone colors. When performance of a natural musical instrument is emulated by an electronic musical instrument, it is necessary to make the tone colors to be faithfully imitated to tone colors of the natural musical instrument. In addition, the performer needs to understand characteristics peculiar to the musical instrument and needs to perform while operating user interfaces of the musical instrument (such as, for example, the keyboard, the pitch-bend lever, the modulation lever, the HOLD pedal and the like) during a performance. Therefore, when a performer attempts to imitate performance of a certain musical instrument, using an electronic musical instrument, the performer needs to have sufficient understanding of the characteristics of the musical instrument to be imitated, and is required to have high-level skills in performance technique to make full use of the user interfaces according to the characteristics during performance.

For example, in a strumming performance technique, which is one of the performance techniques for a guitar, the strings are strummed in a manner to generate tones of notes composing a chord in the order of pitches. When a strumming performance is to be imitated by an electronic musical instrument, it is necessary for the performer to depress keys of the keyboard in a manner that tones composing a chord are successively generated from the low pitch side to the high pitch side or, in reverse, to depress keys of the keyboard in a manner that tones are successively generated from the high pitch side to the low pitch side. In addition, the performer needs to instantaneously perform the operation of depressing keys in the pitch order, such that it requires high-level performance keyboard technique to imitate a strumming performance.

Japanese Patent No. JP 3671545, also published as counterpart U.S. Pat. No. 5,804,755, describes a technology to control generation of tones in upstroke and downstroke based on performance data prepared in advance.

SUMMARY

Provided is an electronic musical instrument comprising: an input device for inputting sound generation instructions of tones at predetermined pitches; a tone generation device that generates tones with predetermined pitches based on sound generation instructions inputted by the input device; a specifying device that specifies a plurality of sound generation instructions inputted by the input device in a predetermined period as a sound generation instruction group; a sorting device that sorts the plurality of sound generation instructions composing the sound generation instruction group specified by the specifying device in a predetermined pitch order; and a control device that controls generation of tones by the tone generation device such that tones corresponding to the sound generation instruction group are generated in the order sorted by the sorting device.

Further provided are a method, computer readable device, and electronic musical instrument performing operations comprising: storing a plurality of notes in a sound generation buffer; determining whether a latest note was inputted within a time threshold of when a previous note was inputted; sorting the notes in the sound generation buffer according to a pitch order in response to determining that the latest note was inputted within the time threshold of when the previous note was inputted; determining sound generation timings at which to generate sounds for the sorted notes in the pitch order; and generating sounds for the sorted notes according to the determined sound generation timings.

DETAILED DESCRIPTION

Figure 1:
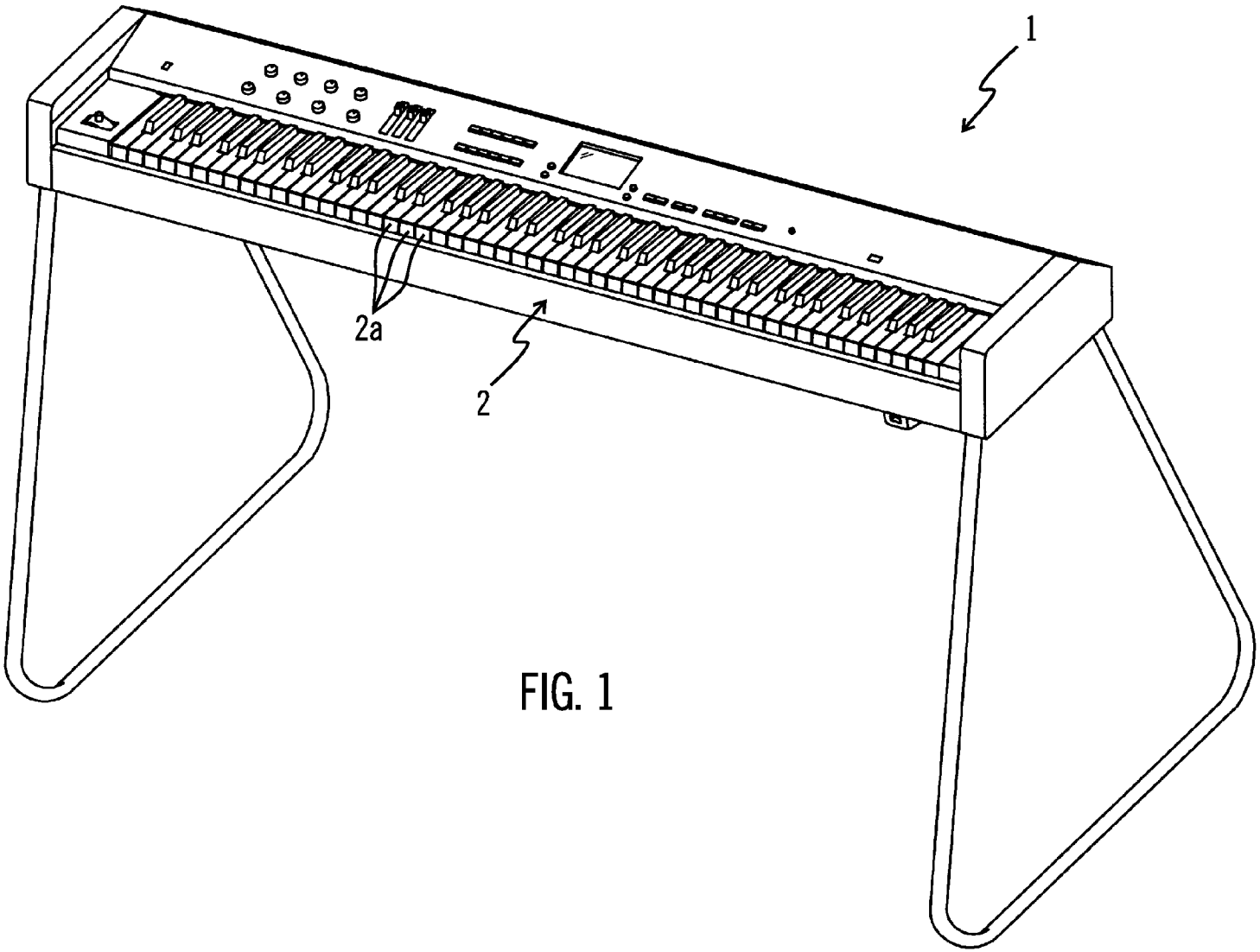
FIG. 1 is an external appearance of an electronic musical instrument.

The technology described in the Japanese Patent 36716545 is based on performance data prepared in advance. Therefore, the problem encountered by the performer, in which high-level performance technique is necessary to imitate a strumming performance based on real-time performance, is not addressed in the above mentioned patent.

Described embodiments provide an electronic musical instrument that can readily realize imitation of a strumming performance played on a string musical instrument based on real-time performance operations by a performer.

In the described electronic musical instrument embodiments, a plurality of sound generation instructions inputted by an input device in a predetermined period is specified as a sound generation instruction group by a specifying device. Then, the plurality of sound generation instructions composing the sound generation instruction group specified is sorted in a predetermined pitch order by a sorting device. Then, generation of tones by a tone generation device is controlled by a control device such that tones corresponding to the sound generation instruction group are generated in the order sorted by the sorting device.

In certain described embodiments, the performer does not need to sequentially input sound generation instructions instantaneously in the pitch order of tones desired to be generated. Instead, by inputting plural sound generation instructions composing a sound generation instruction group in a predetermined period, tones corresponding to the plural sound generation instructions can be sequentially generated in a predetermined order of pitches. Accordingly, for example, when the performer depresses plural keys like playing a chord (in other words, simultaneously or almost simultaneously), tones corresponding to the plural keys depressed can be sequentially generated in a predetermined order of pitches. In this manner, the electronic musical instrument of the described embodiments is effective in readily realizing imitation of a strumming performance played on a string musical instrument (for example, a guitar) based on real-time performance operations by the performer.

In further embodiments, a sound generation instruction group can be specified based on a time difference from a predetermined sound generation instruction. The "predetermined sound generation instruction" may comprise the previous sound generation instruction or the first sound generation instruction in a plurality of sound generation instructions composing a sound generation instruction group.

In further embodiments, a sound generation instruction group can be specified based on a time difference with respect to the previous sound generation instruction.

In further embodiments, a plurality of sound generation instructions inputted by the input device in a predetermined period started from a predetermined sound generation instruction can be specified as a sound generation instruction group. The "predetermined sound generation instruction" may comprise the first sound generation instruction in a plurality of sound generation instructions composing a sound generation instruction group.

In further embodiments, from a start timing based on a timing at which a sound generation instruction group is specified by the specifying device, tones corresponding to the sound generation instruction group can be sequentially generated.

In further embodiments, each time a sound generation instruction is inputted, a tone that is being generated based on a sound generation instructed previously inputted is silenced once, and then tones corresponding to sound generation instructions specified as a sound generation instruction group can be generated in an predetermined order of pitches sorted by the sorting device. This embodiment provides excellent responsiveness in generating tones corresponding to sound generation instructions specified as a sound generation instruction group in response to inputs of sound generation instructions.

In further embodiments, when the reference times respectively specified for two consecutive sound generation instruction groups are within a second predetermined period, the order of pitches to be sorted for a plurality of sound generation instructions composing the latter sound generation instruction group is changed to reverse order. Therefore, when the performer repeatedly inputs sound generation instruction groups, by repeating performances in a manner of playing chords, generation of tones from the low pitch side to the high pitch side and generation of tones from the high pitch side to the low pitch side can be alternately repeated. In other words, by simple performance like in playing chords, the performer can realize a strumming performance in which downstroke and upstroke are alternately played.

In further embodiments, the greater the velocity obtained by a velocity obtaining device, the shorter time interval the tones corresponding to the sound generation instruction group are sequentially generated. Therefore, when sound generation instructions are inputted with the keyboard, the stronger the performer depresses the keys, the shorter interval the tones corresponding to plural sound generation instructions composing a sound generation instruction group are generated. Therefore, by intuitively changing the velocity, the performer can imitate changing the speed of strokes, such that effective strumming performance can be realized by simple performance operation.

The described embodiments of the invention are described with reference to the accompanying drawings. FIG. 1 is an external appearance of an electronic musical instrument 1 in accordance with an embodiment of the invention. As shown in FIG. 1, the electronic musical instrument 1 is an electronic keyboard musical instrument having a keyboard 2 composed of a plurality of keys 2*a*. A performer can play a desired performance piece by depressing or releasing the keys 2*a* of the keyboard 2 of the electronic musical instrument 1.

The keyboard 2 is one of the user interfaces operated by the performer, and outputs to a central processing unit (CPU) 11 (see FIG. 2) note events that are pieces of performance information according to the MIDI (Musical Instrument Digital Interface) standard in response to key-depression and key-release operations on the keys 2*a* by the performer. More specifically, when the key 2*a* is depressed by the performer, the keyboard 2 outputs to the CPU 11 a note-on event (hereafter referred to as a "note-on") that is a piece of performance information indicating that the key 2*a* is depressed. On the other hand, when the key 2*a* that has been depressed by the performer is released, the keyboard 2 outputs to the CPU 11 a note-off event (hereafter referred to as a "note-off") that is a piece of performance information indicating that the depressed key 2*a* is released.

When plural keys 2*a* are key-depressed by the performer in a manner of playing a chord (namely, simultaneously or almost simultaneously), the electronic musical instrument 1 of the present embodiment is configured to assume that the key-depression operation is an attempt to imitate a strumming performance, and successively generates tones corresponding to the depressed keys 2*a* in a predetermined order of pitches. Such a configuration enables imitation of strumming performances played on a string musical instrument (for example, a guitar) through a relatively easy performance operation.

Figure 2:
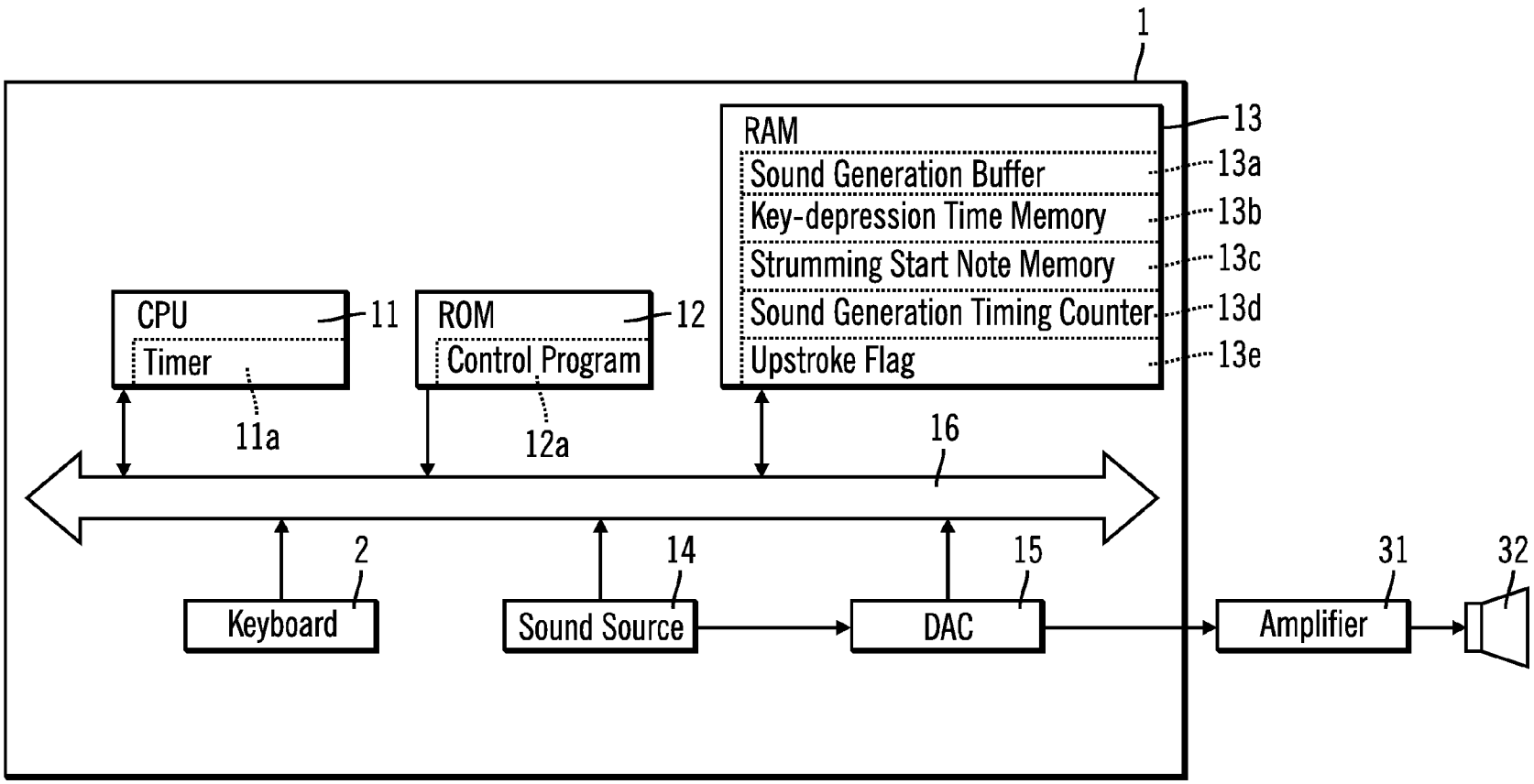
FIG. 2 is a block diagram of an electrical composition of an electronic musical instrument.

FIG. 2 is a block diagram showing an electrical composition of the electronic musical instrument 1. As shown in FIG. 2, the electronic musical instrument 1 includes a CPU 11, a ROM 12, a RAM 13, and a sound source 14; and the components 11-14 and the keyboard 2 are mutually connected through a bus line 16. The electronic musical instrument 1 also includes a digital-to-analog converter (DAC) 15. The DAC 15 is connected to the sound source 14, and is also connected to an amplifier 31 that is provided outside the electronic musical instrument 1.

The CPU 11 is a central control unit that controls each of the components of the electronic musical instrument 1 according to fixed value data and a control program stored in the ROM 12 and the RAM 13. The CPU 11 is built therein with a timer 11 that counts clock signals thereby measuring the time.

Upon receiving a note-on (a piece of performance information indicating that one of the keys 2*a* is depressed) from the keyboard 2, the CPU 11 outputs a sound generation instruction to the sound source 14, thereby rendering the sound source 14 to start generation of a tone (an audio signal) according to the note-on. Also, upon receiving a note-off (a piece of performance information indicating that one of the keys 2*a* having been depressed is released) from the keyboard 2, the CPU 11 outputs a silencing instruction to the sound source 14, thereby performing a silencing control. By this, the tone that is being generated by the sound source 14 is stopped.

Figure 3:
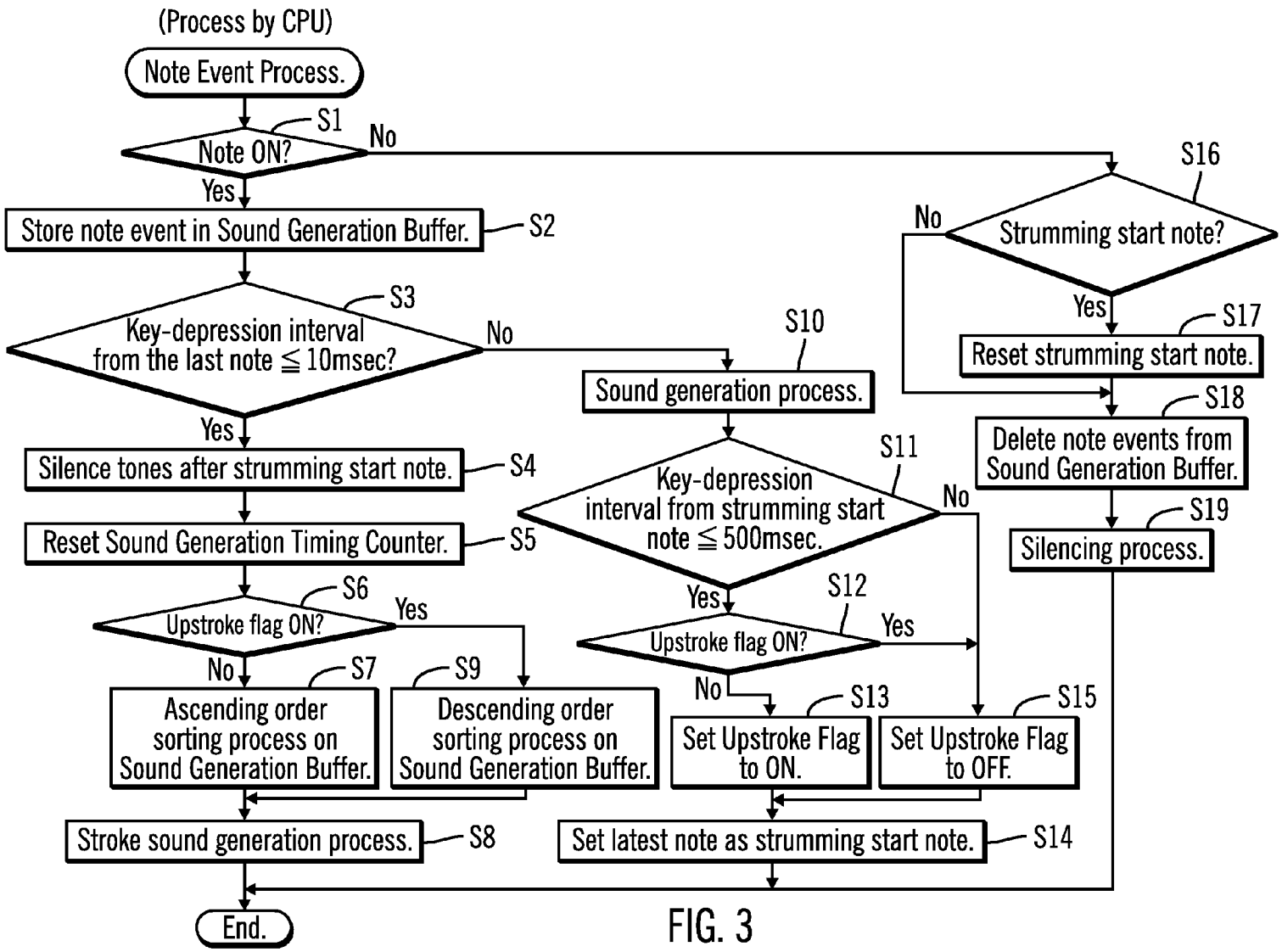
FIG. 3 is a flow chart showing a note event process executed by a Central Processing Unit (CPU) of the electronic musical instrument.
Figure 4:
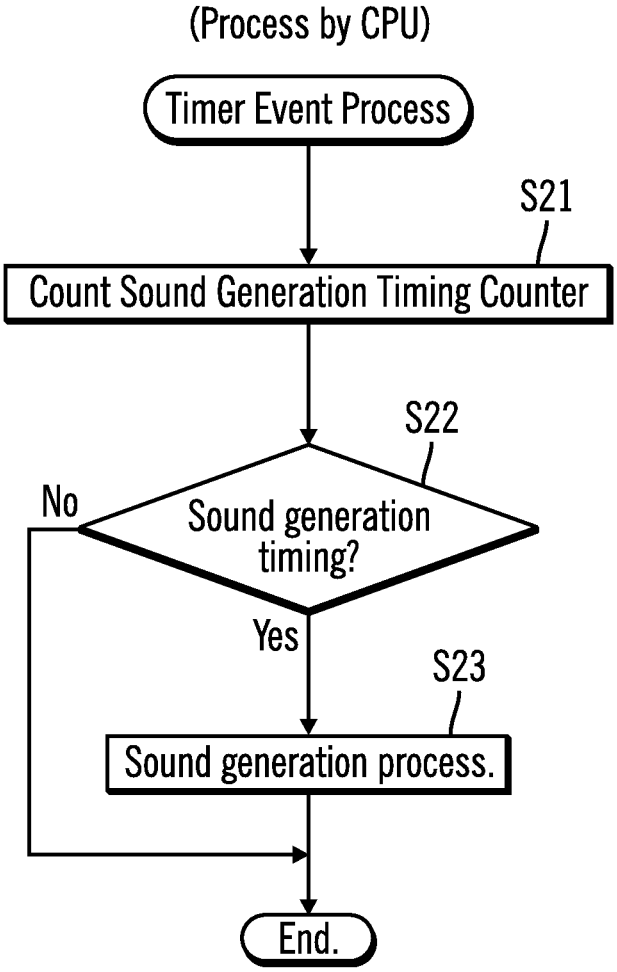
FIG. 4 is a flow chart showing a timer event process executed by the CPU of the electronic musical instrument.

The ROM 12 is a non-rewritable memory, and stores a control program 12*a* to be executed by the CPU 11, fixed value data (not shown) to be referred to by the CPU 11 when the control program 12*a* is executed, and the like. It is noted that each of the processes shown in the flow charts in FIG. 3 and FIG. 4 are executed by the control program 12*a*.

The RAM 13 is a rewritable memory, and has a temporary storage area for temporarily storing various kinds of data for the CPU 11 to execute the control program 12*a*. The temporary area of the RAM 13 is provided with a sound generation buffer 13*a*, a key-depression time memory 13*b*, a strumming start note memory 13*c*, a sound generation timing counter 13*d*, and an upstroke flag 13*e*.

The sound generation buffer 13*a* is a buffer for storing note events (more specifically, note-on events) corresponding to notes to be sound-generated. The sound generation buffer 13*a* is initialized (zeroed) when the electronic musical instrument 1 is powered on. Each time any one of the keys 2*a* is depressed by the performer, the CPU 11 receives a note-on from the keyboard 2, and note-ons are sequentially stored in the sound generation buffer 13*a*. The CPU 11 outputs sound generation instructions, to the sound source 14, corresponding to the respective note-ons stored in the sound generation buffer 13*a* sequentially in the order from the earliest note-on (in other words, the one with the earliest key-depression time) first. On the other hand, note-ons stored in the sound generation buffer 13*a* are erased when those of the keys 2*a* corresponding to the note-ons are key-released.

When plural ones of the keys 2*a* are depressed simultaneously or generally simultaneously by the performer, each time each of the keys is depressed, note-ons (more specifically, note-ons after a strumming start note) stored in the sound generation buffer 13*a* are configured to be sorted in the order of pitches according to a setting of the upstroke flag 13*e*. With this configuration, when the performer depresses plural ones of the keys 2*a* in a manner of playing a chord, tones respectively corresponding to the plural keys 2*a* depressed are sequentially generated in a predetermined pitch order (in an ascending order or in a descending order), like in a strumming performance played on a string musical instrument, irrespective of the key-depression order of the keys.

The key-depression time memory 13*b* is a memory that stores key-depression times in the order of key-depression. The key-depression time memory 13*b* is initialized when the electronic musical instrument 1 is powered on. Then, times measured by the timer 11 a upon reception of note-ons by the CPU 11 from the keyboard 2 are sequentially stored in the key-depression time memory 13*b* together with notes (note numbers) indicated by the note-ons received. The present embodiment is configured to store a predetermined number of (for example, 10) newest key-depression times in the order of key-depression. However, it can be configured to erase a key-depression time of a note corresponding to any of the keys 2*a* that is key-released. A key depression interval between two consecutive key-depressions is calculated based on a difference between the key-depression time of key-depression this time and the key-depression time of key-depression last time, according to the content stored in the key-depression time memory 13*b*.

The strumming start note memory 13*c* is a memory that stores a note corresponding to a key-depression that could be the first key-depression among multiple consecutive key-depressions composing a strumming (a stroke) as a strumming start note. The strumming start note memory 13*c* is initialized when the electronic musical instrument 1 is powered on. Then, when the keys 2*a* depressed, and the key-depression interval between a latest note (a note corresponding to the key-depression this time) and a previous note (a note corresponding to the key-depression last time) exceeds 10 msec that is defined as a strumming judgment time, the latest note is stored as a strumming start note in the strumming start note memory 13*c*. The content stored in the strumming start note memory 13*c* is zeroed when the key 2*a* corresponding to the strumming start note is released.

The sound generation timing counter 13*d* is a counter that measures, when tones corresponding to multiple consecutive key-depressions composing a single strumming are sequentially generated, the sound generation timing for each of the tones. The sound generation timing counter 13*d* is reset to an initial value that is zero, each time the latest note is judged (specified) as one of strumming subject notes. It is noted that the "strumming subject notes" are a group of notes corresponding to multiple consecutive key-depressions composing each single strumming (a stroke). Meanwhile, the sound generation timing counter 13*d* is counted up by 1 each time the timer event process (see FIG. 4) is executed. Based on the value of the sound generation timing counter 13*d*, tones corresponding to multiple consecutive key-depressions composing each single strumming (in other words, tones corresponding to strumming subject notes) are sequentially switched and generated in the order of sorted pitches.

The upstroke flag 13*e* is a flag that specifies a sorting order applied at the time of sorting notes corresponding to strumming subject notes in the order of pitches. When the upstroke flag 13*c* is set to ON, the sorting order is set to the order of pitches corresponding to an upstroke played on a string musical instrument, in other words, the order of pitches from the high pitch side to the low pitch side (a descending order). On the other hand, when the upstroke flag 13*e* is set to OFF, the sorting order is set to the order of pitches corresponding to downstroke played on a string musical instrument, in other words, the order of pitches from the low pitch side to the high pitch side (an ascending order).

When the electronic musical instrument 1 is powered on, or when the key-depression interval between the latest note and the strumming start note stored in the strumming start note memory 13*c* exceeds an alternate judgment time that is defined to be 500 msec, the upstroke flag 13*e* is initialized (set to OFF). On the other hand, when the key-depression interval between the latest note and the strumming start note is the alternate judging time or less, and therefore it is judged that a new round of strumming is started, ON and OFF of the upstroke flag 13*e* is switched.

The sound source 14 generates tones with a tone color set by the performer at pitches corresponding to those of the keys 2*a* depressed or stops tones that are being generated, based on sound generation instructions or silencing instructions received from the CPU 11, respectively. Upon receiving a sound generation instruction from the CPU 11, the sound source 14 generates a tone (an audio signal) with a pitch, a sound volume and a tone color according to the sound generation instruction. The tone generated by the sound source 14 is supplied to the DAC 16 and converted to an analog signal, and outputted through an amplifier 31 from a speaker 32. On the other hand, upon receiving a silencing instruction from the CPU 11, the sound source 14 stops a tone that is being generated according to the silencing instruction. Accordingly, the tone that is being outputted from the speaker 32 is silenced.

Next, referring to FIG. 3 and FIG. 4, the process executed by the CPU 11 of the electronic musical instrument 1 in accordance with the present embodiment having the composition described above will be described. FIG. 3 is a flow chart of a note event process executed by the CPU 11. The note event process is executed each time the CPU 11 receives a note event (a note-on or a note-off) from the keyboard 2, when a tone color of a guitar is set.

As shown in FIG. 3, in the note event process, first, it is judged as to whether or not a note event received from the keyboard 2 is a note-on (S1). When the note event received is judged to be a note-on (S1: Yes), the received note event (the note-on) is stored in the sound generation buffer 13*a* (S2). Then, referring to the key-depression time memory 13*b*, it is judged as to whether or not the key-depression interval between the latest note (a note of the key depressed this time) and the previous note (a note of the key depressed last time) is 10 msec or less that is defined as a strumming judgment time (S3).

In S3, if it is judged that the key-depression interval with respect to the previous note exceeds the strumming judgment time (10 msec) (S3: No), the process proceeds to S10. If it is judged in S3 that no key-depression time for the previous note is present in the key-depression time memory 13*b*, the process also proceeds to S10.

In S10, a sound generation process according to the note-on received from the keyboard 2 is executed (S10). More specifically, a sound generation instruction according to the received note-on is outputted to the sound source 14, thereby generating a tone corresponding to the latest note.

After the processing in S10, by referring to the key-depression time memory 13*b*, it is judged as to whether or not the key-depression interval between the latest note and the strumming start note stored in the strumming start note memory 13*c* is 500 msec or less that is defined as an alternate judgment time (S11).

When it is judged in S11 that the key-depression interval between the latest note and the strumming start note exceeds the alternate judgment time (S11: No), it is assumed that the performer does not intend to play a strumming performance of alternating downstroke and upstroke, and the upstroke flag 13*e* is set to OFF (S15). As the upstroke flag 13*e* is set to OFF (initialized), a downstroke strumming in which tones are generated in the order from the high pitch side to the low pitch side is executed, when the performer operates plural ones of the keys 2*a* with an intention to start a strumming. After the processing in S15, the latest note is stored in the strumming start note memory 13*c*, thereby setting the latest note as a strumming start note (S14), and then the note event process is ended.

On the other hand, when it is judged in S3 that the key-depression interval between the latest note and the previous note equals to the strumming judgment time (10 msec) or less (S3: Yes), it is assumed that the performer executed a key-depression operation in a manner of playing a chord on plural ones of the keys 2*a* with an intention to perform a strumming, and each of the processings to imitate a strumming performance is executed.

More specifically, when an affirmative (Yes) judgment is made in S3, a silencing instruction corresponding to notes after the strumming start note is outputted to the sound source 14, thereby silencing tones after the strumming start note (S4). After the processing in S4, the sound generation timing counter 13*d* is reset (S5).

After the processing in S5, it is judged as to whether or not the upstroke flag 13*e* is set to ON (S6). When it is judged that the upstroke flag 13*e* is set to OFF (S6: No), an ascending sort processing on the sound generation buffer is executed (S7). In the ascending sort processing on the sound generation buffer (S7), note-ons stored in the sound generation buffer 13*a* are sorted in a manner that the notes are arranged in the ascending pitch order (from the low pitch side to the high pitch side).

On the other hand, when it is judged in S6 that the upstroke flag 13*e* is set to ON (S6: Yes), a descending sort processing on the sound generation buffer is executed (S9). In the descending sort processing on the sound generation buffer (S9), note-ons stored in the sound generation buffer 13*a* are sorted in a manner that the notes are arranged in the descending pitch order (from the high pitch side to the low pitch side).

After the processing in S7 or S9, a stroke sound generation process is executed (S8), and the note event process is ended. In the stroke sound generation process (S8), the sound generation timing of each of the note-ons that have been sorted in the ascending pitch order or in the descending pitch order is decided according to the velocity of the latest note, and a sound generation instruction according to the first note-on in the sound generation buffer 13*a* after having been sorted is outputted to the sound source 14, thereby generating a corresponding tone. It is noted that the manner of deciding the sound generation timing according to the velocity of the latest note will be described below with reference to FIG. 6 and FIG. 7.

Also, in S11, when it is judged that the key-depression interval between the latest note and the strumming start note equals to the alternate judgment time (500 msec) or less (S11: Yes), it is assumed that the performer changed the chord to play with an intention to switch the stroke direction, and therefore a processing to switch between ON and OFF of the upstroke flag 13*e* is executed.

More specifically, when the judgment in S11 is affirmative (Yes), it is judged as to whether or not the upstroke flag 13*e* is set to ON (S12). When it is judged that it is set to OFF (S12: No), the upstroke flag 13*e* is set to ON (S13). On the other hand, when the upstroke flag 13*e* is judged that it is set to ON (S12: Yes), the upstroke flag 13*e* is set to OFF (S15). After the processing in S13 or S15, the latest note is stored in the strumming start note memory 13*c*, thereby setting the latest note as a strumming start note (S14), and the note event process is ended.

On the other hand, in S1, when the note event received from the keyboard 2 is judged to be a note-off (S1: No), it is then judged as to whether or not the received note-off corresponds to the note (the strumming start note) stored in the strumming start note memory 13*c* (S16).

In S16, when the note-off received is judged to correspond to the strumming start note (S16: Yes), the strumming start note memory 13*c* is zeroed, thereby resetting the strumming start note (S17), and the process proceeds to S18. On the other hand, in S16, when the received note-off is judged not to correspond to the strumming start note (S16: No), the process proceeds to S18.

In S18, the note event corresponding to the note-off received is erased from the sound generation buffer 13*a* (S18). Then, a silencing process according to the note-off received is executed (S19). More specifically, a silencing instruction according to the note-off received is outputted to the sound source 14, thereby silencing generation of the tone corresponding to the key released. After the processing in S19, the note event process is ended.

FIG. 4 is a flow chart showing a timer event process executed by the CPU 11. The timer event process is a process to be started by interrupt processings executed every 10 msec, when a tone color with which the note event process described above in FIG. 3 is set. In the timer event process, first, the value of the sound generation timing counter 13*d* is counted up (S21).

Then, it is judged as to whether or not the value of the sound generation timing counter 13*d* counted up has reached a sound generation timing (S22). The sound generation timing is decided by the stroke sound generation processing in S8 in the note event process (See FIG. 3) described above. When it is judged in S22 that the value of the sound generation timing counter 13*d* has not reached the sound generation timing (S22: No), the timer event process is ended.

On the other hand, when it is judged in S22 that the value of the sound generation timing counter 13*d* has reached the sound generation timing (S22: Yes), a sound generation instruction for the next note-on stored in the sound generation buffer 13*a* is outputted to the sound source 14, thereby generating a corresponding tone (S23), and the timer event process is ended.

According to each of the processes in FIG. 3 and FIG. 4 described above, when plural ones of the keys 2*a* are depressed at a key-depression interval equal to the strumming judgment time (10 msec in the present embodiment) or less, it is assumed that these keys are depressed to imitate a strumming performance, and notes corresponding to these keys 2*a* are specified as strumming subject notes. Further, each time the CPU 11 receives a note-on from the keyboard 2, silencing of tones corresponding to the strumming subject notes up to the previous note, sorting of the strumming subject notes including the latest note in an order of pitches, and sequential sound generation of the strumming subject notes after the sorting are executed. Therefore, for example, when the performer depresses plural keys 2*a* simultaneously or almost simultaneously like playing a chord, tones of the plural keys 2*a* depressed can be sequentially generated in a predetermined pitch order (in a pitch order according to the setting of the upstroke flag 13*e*).

Further, when a group of strumming subject notes and another group of strumming subject notes are depressed at an interval equal to the alternate judgment time (500 msec in the present embodiment) or less, it is assumed that the stroke direction is changed, and the setting of the upstroke flag 13*e* is switched each of such occasions. Therefore, when the performer repeats key-depression of plural keys 2*a* simultaneously or almost simultaneously, as in playing chords, a strumming performance that repeats downstroke and upstroke can be imitated.

When a group of strumming subject notes and another group of strumming subject notes are depressed at an interval exceeding the alternate judgment time, it is assumed that a strumming performance that alternately repeats downstroke and upstroke is not imitated, and the upstroke flag 13*e* is set to OFF. Therefore, when the performer starts imitating a strumming performance by key-depression of keys 2*a*, the first strumming subject note can always be generated as if it is played in downstroke, which can imitate a general tendency of strumming played on a string musical instrument.

Figure 5:
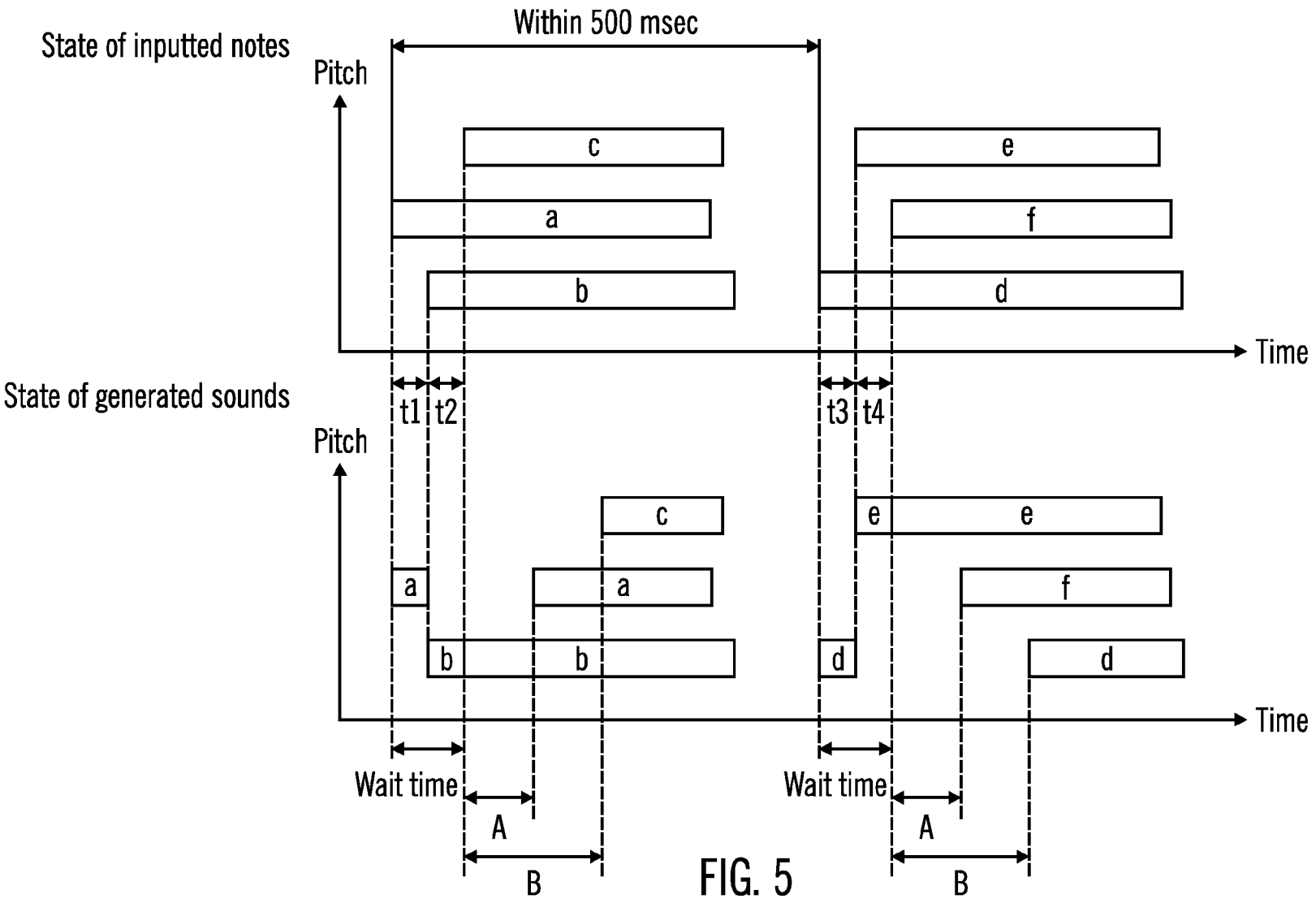
FIG. 5 is a diagram for explaining the state of notes inputted through key-depression of keys by the performer and the state of actual sound generation.

Next, referring to FIG. 5, the manner of imitating a strumming performance by the note event process (see FIG. 3) and the timer event process (see FIG. 4) described above will be described in greater detail. FIG. 5 is a diagram for explaining the state of notes inputted through key-depression of keys 2*a* by the performer and the state of actual tones generated.

In FIG. 5, a graph on the upper side shows time-series states of notes inputted through key-depression operation by the performer, and a graph on the lower side shows time-series states of actual tones generated according to the note states shown in the upper graph. Both of the graphs plot tone pitches (pitches) along the vertical axis and time along the horizontal axis.

Let us assume that the performer inputs a note a, a note b with a lower pitch than the note a, and a note c with a higher pitch than the notes a and b, in this order, as shown in the upper graph.

In this case, as shown in the lower graph, first, a tone corresponding to the note a is generated in response to an input of the note a. At this time, the note a is set as a strumming start note.

When the key-depression interval (time t1) between the note a and the note b equals to the strumming judgment time (10 msec) or less, the note b is judged (specified) to be a note composing strumming subject notes together with the previous note, the note a. Accordingly, the tone corresponding to the note a being generated is once silenced. Following the tone silencing, a tone of the first note in the notes a and b that are sorted in an ascending pitch order based on a setting of the upstroke flag 13*e*, in other words, a tone of the note b, having a lower pitch among these two notes, is generated.

When the key-depression interval (time t2) between the note b and the note c equals to the strumming judgment time (10 msec) or less, the note c is judged to be a note composing the strumming subject notes together with the note a and the note b. Accordingly, the tone corresponding to the note b being generated is once silenced. Following the tone silencing, a tone of the first note in the notes a, b and c that are sorted in an ascending pitch order based on the setting of the upstroke flag 13*e*, in other words, a tone of the note b, having the lowest pitch among these three notes, is generated again (re-triggered and generated).

After the tone of the note b is re-generated, the tones corresponding to these three notes a-c, with the timing of the tone re-generation being as a strumming imitation start timing, are sequentially generated in an ascending pitch order (in other words, in the order from the low pitch toward the high pitch). In other words, the tone corresponding to the note a that is a note with the second pitch from the lowest is generated at a tone generation timing delayed by a delay time A from the tone re-generation timing of the note b. Meanwhile, the tone corresponding to the note c that is a note with the highest pitch among the three notes a-c is generated at a tone generation timing delayed by a delay time B, which is longer than the delay time A, from the tone re-generation timing of the note b. Although details will be discussed later, the delay time A and the delay time B measured from the strumming imitation start timing are decided based on the velocity of the latest note.

Next, let us assume that the performer inputs a note d, a note e with a pitch higher than the note d, and a note f with a pitch higher than the note d but lower than the note e, in this order, within an alternate judgment time (500 msec), from the input timing (in other words, the key-depression timing) of the note a that has been inputted earliest among the notes a-c composing the group of strumming subject notes, as shown in the graph on the upper side.

In this case, as shown in the graph in the lower side, first, a tone corresponding to the note d is generated in response to the input of the note d. At this time, the note d is set as a strumming start note, and the setting of the upstroke flag 13*e* is switched from OFF to ON.

When the key-depression interval (time t3) between the note d and the note e equals to the strumming judgment time (10 msec) or less, the note e is judged to be a note composing strumming subject notes together with the previous note, i.e., the note d. Accordingly, the tone corresponding to the note d being generated is once silenced. Following the tone silencing, a tone of the first note in the notes d and e that are sorted in a descending pitch order based on a setting of the upstroke flag 13*e*, in other words, a tone of the note e, having a higher pitch among these two notes, is generated.

When the key-depression interval (time t4) between the note e and the note f equals to the strumming judgment time or less, the note f is judged to be a note composing the strumming subject notes together with the note d and the note e. Accordingly, the tone corresponding to the note e being generated is once silenced. Following the tone silencing, a tone of the first note in the notes d, e and f that are sorted in a descending pitch order based on the setting of the upstroke flag 13*e*, in other words, a tone of the note e, having the highest pitch among these three notes, is generated again (re-triggered and generated).

After the tone of the note e is re-generated, the tones corresponding to these three notes d-f, with the timing of the tone re-generation being as a strumming imitation start timing, are sequentially generated in a descending pitch order (in other words, in the order from the high pitch toward the low pitch). In other words, the tone corresponding to the note f that is a note with the second pitch from the highest is generated at a tone generation timing delayed by a delay time A from the tone re-generation timing of the note e. Meanwhile, the tone corresponding to the note d that is a note with the lowest pitch among the three notes d-f is generated at a tone generation timing delayed by a delay time B, which is longer than the delay time A, from the tone re-generation timing of the note e.

As described above, according to the electronic musical instrument 1 of the present embodiment, when the performer depresses plural ones of the keys 2*a* at a key-depression interval equal to the strumming judgment time (10 msec or less), and after a wait time has elapsed, the wait time starting from the time the first one of the plural keys 2*a* is depressed until the time the last one of the plural keys is depressed, tones corresponding to the plural keys 2*a* depressed are sequentially generated in a pitch order based on a setting of the upstroke flag 13*e*, Therefore, the performer can imitate a strumming (stroke) by simple key-depression operation like playing a chord.

During the wait time, each time one of the keys is depressed, tone generation and tone silencing are instantaneously repeated. Therefore, the repetition of these instantaneous tone generation and tone silencing would be heard as noise. However, because strumming played on a guitar is somewhat noisy at attack portions to begin with, such noise may be audible but not annoying.

Also, when the performer depresses keys, in a manner of playing chords, at an interval equal to the alternate judgment time (500 msec) or less, the order of tone generation of tones corresponding to the respective plural keys 2*a* depressed at the key-depression interval equal to the strumming judgment time, is alternately switched between an ascending pitch order and a descending pitch order, whereby a strumming performance that alternately repeats downstroke and upstroke can be imitated.

Figure 6:
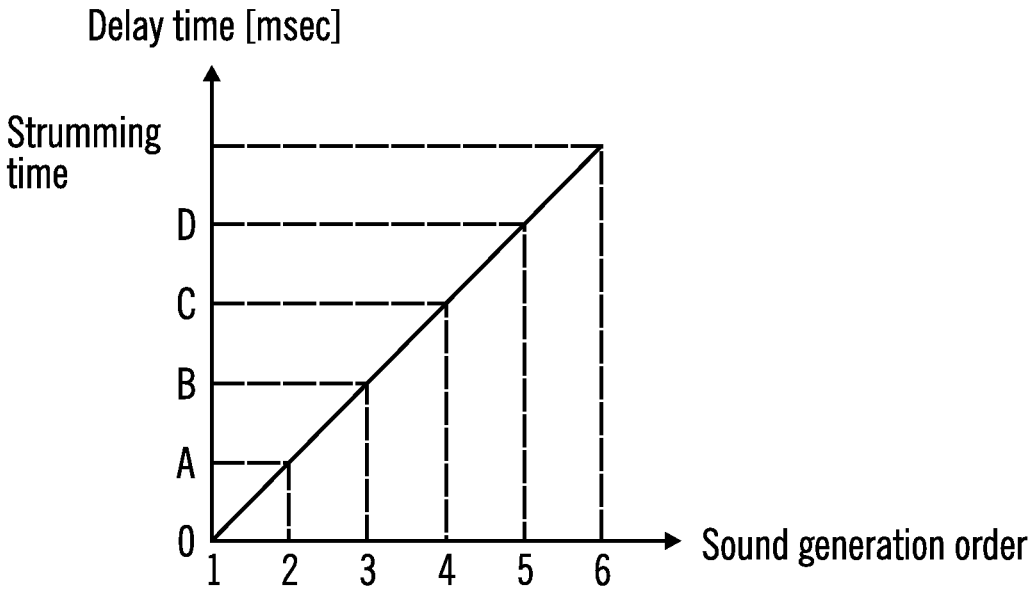
FIG. 6 is a graph showing an example of relationship between the order of sound generation and delay times from a start timing of a strumming imitation.

Next, referring to FIG. 6 and FIG. 7, tone generation timings of tones corresponding to a group of strumming subject notes will be described. FIG. 6 is a graph showing an example of the relation between the order of tone generation and delay times from the start timing of a strumming simulation. In the present embodiment, the relation between the order of tone generation and delay times from the start timing of a strumming simulation, as shown in FIG. 6, is provided for each tone color (in other words, each musical instrument).

The horizontal axis of the graph in FIG. 6 shows the order of tone generation of notes. FIG. 6 shows an example in which the tone color is set to a guitar, and the maximum value along the horizontal axis is set to 6 based on the number of the strings (six strings) of the guitar. On the other hand, the vertical axis of the graph in FIG. 6 shows delay times from the start timing of the strumming imitation. The maximum value in the delay times is referred to as a "strumming time." The value of the strumming time changes according to the velocity of the latest note, as described below with reference to FIG. 7.

The example shown in FIG. 6 defines a relation in which, as the values in the order of tone generation of notes increase from the minimum value 1 to the maximum value 6, the delay time (msec) linearly increases from zero to the strumming time that is the maximum value. Based on the linear line, the delay times A-D to be applied to the second through fifth notes are decided, respectively. In other words, in this case, the delay time to be applied to the nth note is calculated by {the strumming time/(the maximum value in the tone generation order−1)}×(n−1), and tone generation intervals of the tones in the tone generation order become equal to one another. It is noted that n is a variable indicating a note in the order of tone-generation, and is any one of integers up to the maximum value of the tone generation order (6 in the example shown in FIG. 6).

In the example shown in FIG. 6, the delay time is set to linearly increase relative to the tone generation order. However, the tone generation order and the delay time are not limited to such a linearly increasing relation, but may be in a logarithmically increasing relation (an upwardly convex monotonic increase or a downwardly convex monotonic increase). Also, the tone generation order and the delay time may be linearly related for a certain tone color, but may be changed to a different relation depending on tone colors, for example, in a logarithmic relation for another tone color.

Also, in the example shown in FIG. 6, when the tone color is set to be a guitar, the maximum value in the tone generation order is set to be six. However, when the number of strumming subject notes exceed six, the delay time for the seventh note and above may use the same delay time (strumming time) as used for the sixth note. Accordingly, the number of tones to be generated, respectively shifted by delays, is restricted to a maximum of the number of the strings of the guitar, such that a strumming performance characteristic to a musical instrument according to the set tone color (the guitar in this case) can be realized.

Figure 7:
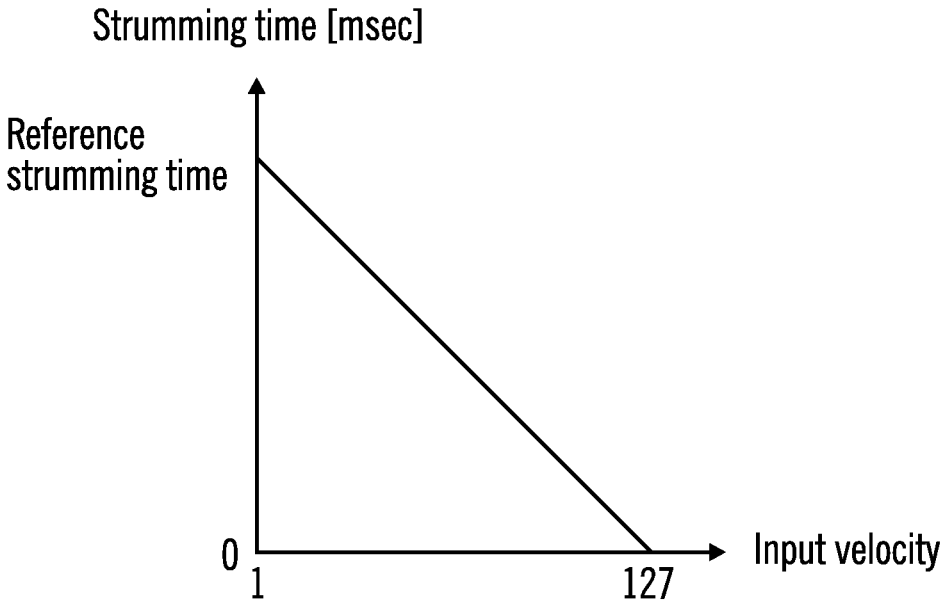
FIG. 7 is a graph showing an example of relationship between the velocity and the strumming time.

FIG. 7 is a graph showing an example of the relation between the velocity and the strumming time described above. The horizontal axis of the graph of FIG. 7 shows velocities respectively defined by numerical values of 1-127 according to the MIDI standard. On the other hand, the vertical axis of the graph of FIG. 7 shows strumming times (msec).

As shown in FIG. 7, the velocity and the strumming time are set to have a relation in which the strumming time gradually becomes shorter with an increase in the velocity. In the example of FIG. 7, as the velocity is increased from the minimum value of 1 to the maximum value of 127, the strumming time is set to linearly decrease from a predetermined maximum value (hereafter referred to as a "reference strumming time") to a minimum strumming time (zero in the example shown in FIG. 7). It is noted that the reference strumming time is, for example, about 50 msec.

When one of the keys 2*a* is depressed, the strumming time according to the velocity of the depressed key (the latest note) is decided based on the relation shown in FIG. 7, and each of the delay times to be applied to tones in the tone generation order is decided with the decided strumming time being set as the maximum value on the vertical axis of the graph in FIG. 6 described above. Therefore, in comparing two tones in the same generation order (the nth), the greater the velocity of the latest note, in other words, the stronger the performer depresses the key, the shorter the delay time is decided. It is noted that the delay times A and B used in the operation example shown in FIG. 5 described above correspond to the delay times A and B, respectively, among the delay times to be applied to tones in the sound generation order decided based on the relation shown in FIG. 6 and FIG. 7.

There is a tendency that performers would express the speed of a stroke at strumming intuitively with the intensity (the velocity) in depressing keys. In other words, there is a tendency that, the faster a stroke, the stronger the keys would be depressed. Therefore, according to the electronic musical instrument 1 of the present embodiment, as the relation in which, the greater the velocity, the shorter the strumming time becomes, as shown in FIG. 7, is defined, the performer can imitate the speed of strokes intuitively with the intensity in key-depression, such that effective strumming performance can be realized by simple performance operations.

Also, in the example shown in FIG. 7, the strumming time becomes zero at the maximum velocity. Therefore, all tones corresponding to the strumming subject notes would be simultaneously generated without depending on the tone generation order, after the wait time (see FIG. 5) has elapsed. Therefore, when the keys are depressed with the maximum velocity, an impression of strokes played on the strings with a great speed, which does not sound like a strumming, can be imitated.

In the example shown in FIG. 7, the relation between the velocity and the strumming time is set in a manner that the strumming time linearly reduces with an increase in the velocity. However, as long as the strumming time monotonically reduces with respect to an increase in the velocity, their relation is not limited to a linear decrease, but may be a logarithmic decrease or the like, like the example shown in FIG. 6. Also, the relation between the velocity and the strumming time may be changed according to a tone color. Also, the minimum value of the strumming time to be made to correspond to 127, the maximum value of the velocity, does not need to be zero.

As described above, according to the electronic musical instrument 1 of the present embodiment, when plural ones of the keys 2*a* are depressed at a key-depression interval equal to the strumming judgment time (10 msec) or less, all notes corresponding to these plural keys 2*a* are defined as strumming subject notes, tones corresponding to these strumming subject notes are sorted according to a predetermined pitch order (a pitch order according to the setting at the upstroke flag 13*e*), and sequentially tone-generated according to the sorted order (in other words, in the predetermined pitch order). In other words, according to the electronic musical instrument 1, notes of keys depressed within a predetermined period defined as the strumming judgment time for each key-depression are sequentially generated according to a predetermined pitch order. Therefore, for example, as the performer simply depresses plural ones of the keys 2*a* like playing a chord, each stroke in a strumming performance can be imitated.

Further, each time the CPU 11 receives a note-on (in other words, each time one of the keys 2*a* is depressed), the CPU 11 specifies, based on a key-depression interval with respect to the previous note, if the latest note is one of notes composing strumming subject notes. If the latest note is specified as one of the strumming subject notes, silencing of tones being generated and re-generation of tones according to a sorted order are repeated at each of such occasions. Therefore, the embodiment provides an excellent responsiveness in the tone generation in a strumming (a stroke) at the key-depression timing at which the performer depresses keys, thereby preventing a feeling of wrongness from taking place in the performance feelings of the performer. Also, each time one of the keys 2*a* is depressed, silencing of tones being generated and generation of tones according to a sorted order are instantaneously repeated, which would be heard as noise. However, because, in the first place, strumming played on a guitar is somewhat noisy at attack portions, such noise may be audible but not annoying.

Also, when the performer depresses keys, like playing different chords, at an interval equal to the alternate judgment time (500 msec) or less, the tone generation order of tones corresponding to the plural keys 2*a* depressed at a key-depression interval equal to the strumming judgment time is alternately switched between an ascending pitch order and a descending pitch order, such that a strumming performance of repeating downstroke and upstroke can be readily imitated.

The invention has been described above based on some embodiments. However, the invention is not at all limited to the embodiments described above, and it can be readily presumed that various modifications and improvements can be made within the range that does not depart from the subject matter of the invention.

For example, embodiments described above are configured such that the CPU 11 executes each of the processings shown in FIG. 3 and FIG. 4, thereby enabling the performer to readily realize a strumming performance played on a string musical instrument such as a guitar. However, processings corresponding to the processings shown in FIG. 3 and FIG. 4 may be executed by the sound source 15.

Also, embodiments described above are configured such that the processings shown in FIG. 3 and FIG. 4 are executed when a tone color of a guitar is set. However, the configuration is not limited to a guitar, and is similarly applicable to other tone colors of any string musical instruments that are capable of strumming performance like a guitar.

Also, in embodiment described above, when the key-depression interval between the latest note and the previous note equals to the strumming judging time (10 msec) or less, the latest note is judged (specified) to be one of the strumming subject notes. However, the method to judge as to whether or not the latest note is included in the strumming subject notes is not limited to the method described above. For example, a configuration to judge based on the key-depression interval between the latest note and the strumming start note may be used. For example, when the latest note is the second note from the strumming start note, and if the key-depression interval between the key-depression time of the latest note and the key-depression time of the strumming start note is 20 msec, which equals to (the strumming judgment time×2), or less, the latest note can be judged as one of the strumming subject notes. According to another configuration, when there is one or plural notes that are key-depressed within a predetermined period of time (for example, 50 msec) from a strumming subject note, that note (these notes) and the strumming subject note may be judged as strumming subject notes.

Also, embodiments described above are configured such that, as shown in FIG. 6, the delay time for the first note in the tone generation order is set to zero. In other words, immediately after silencing a tone being generated, the first note is re-generated. If noise is audible and annoying due to such a configuration, an appropriate offset may be provided (in other words, the delay time for the first note may be set to a value greater than zero), although the responsiveness in performance may be slightly sacrificed.

Also, the embodiment described above is configured such that, when the latest note is a strumming subject note, a tone being generated is once silenced, and a tone corresponding to the first note in the order of sorted pitches is generated. Therefore, when a note to be silenced and the first note in the order of sorted pitches coincide with each other, the note that is silenced is re-triggered. Instead, when the note to be silenced and the first note in the order of sorted pitches coincide with each other, the tone generation may be continued without executing silencing. In this case, an appropriate timing (for example, a timing at which a note to be silenced and the first noted in the sorted order are judged to coincide with each other) may be set as the start timing of strumming imitation.

In embodiments described above, the strumming judgment time is set to 10 msec. However, any appropriate value may be used without any particular limitation to 10 msec. For example, the strumming judgment time may be set to a value of about 20 msec.

In embodiments described above, the alternate judgment time is set to 500 msec. However, any appropriate value may be used without any particular limitation to 500 msec. Further, an alternate judgment time may be provided for each of music patterns (for example, Rocks, Pops, etc.), the performer may select any one of the music patterns using an operation button or the like, and the alternate judgment time according to the music pattern selected by the performer may be used.

Also, in embodiments described above, the key-depression time of a strumming start note, which is a first key-depressed note, among notes included in the strumming subject notes is set as the reference time, and when the key-depression interval from the reference time to the key-depression time of the latest note equals to the alternate judgment time or less, the latest key-depressed note is set as a new strumming start note. However, the reference time for measuring the alternate judgment time may be any time at which a group of strumming subject notes can be specified, without any particular limitation to the key-depression time of the strumming start note. For example, the key-depression time of a note that is key-depressed second among the strumming subject notes may be used as the reference time.

Also, in embodiments described above, the electronic musical instrument 1 constructed in one piece with the keyboard 2 is used. However, an electronic musical instrument in accordance with the invention may be configured as a sound source module that can be detachably connected to a keyboard that outputs note-on and note-off signals like the keyboard 2, a sequencer or the like.

What is claimed is:

1. An electronic musical instrument comprising:

an input device for inputting sound generation instructions of tones for note-on events at predetermined pitches;

a tone generation device that generates tones with predetermined pitches based on sound generation instructions inputted by the input device;

a sound generation buffer storing the sound generation instructions inputted by the input device;

a specifying device that specifies a plurality of sound generation instructions in the sound generation buffer inputted by the input device in a first predetermined period as a sound generation instruction group in response to receiving the sound generation instructions from the input device to produce the tones corresponding to the inputted sound generation instructions;

a sorting device that sorts the plurality of sound generation instructions in the sound generation buffer comprising the sound generation instruction group specified by the specifying device in a predetermined pitch order in response to the specifying device specifying the sound generation instruction group, wherein, when reference times respectively set for two consecutive sound generation instruction groups are within a second predetermined period, the pitch order in sorting a plurality of sound generation instructions composing a latter sound generation instruction group of the two consecutive sound generation instruction groups is changed to reverse order; and a control device that controls generation of tones by the tone generation device such that tones corresponding to the sound generation instruction group stored in the sound generation buffer are generated in the pitch order sorted by the sorting device to imitate a strumming performance played on the string instrument.

2. The electronic musical instrument of claim 1, wherein the specifying device specifies the sound generation instruction group, each time a sound generation instruction is inputted by the input device, based on a time difference from a predetermined sound generation instruction.

3. The electronic musical instrument of claim 2, wherein the specifying device specifies the sound generation instruction group, each time a sound generation instruction is inputted by the input device, based on a time difference from a last sound generation instruction.

4. The electronic musical instrument of claim 1, wherein the specifying device specifies a plurality of sound generation instructions inputted by the input device within the first predetermined period from a predetermined sound generation instruction as a sound generation instruction group.

5. The electronic musical instrument of claim 1, wherein the control device controls to generate tones corresponding to the sound generation instruction group sequentially from a start timing based on a timing at which the sound generation instruction group is specified by the specifying device.

6. The electronic musical instrument of claim 1, wherein the control device controls to generate tones corresponding to the sound generation instruction group sequentially, after silencing tones being generated by the tone generation device.

7. The electronic musical instrument of claim 1, further comprising a velocity obtaining device that obtains a velocity of a sound generation instruction inputted by the input device, wherein the control device controls to generate sequentially tones corresponding to the sound generation instruction group at a shorter time interval for a greater velocity obtained by the velocity obtaining device.

8. A method, comprising:

storing a plurality of notes in a sound generation buffer generated in response to note-on events from a musical instrument, wherein the stored notes correspond to the note-on events to be sound generated and include a start note;

determining whether a latest note of the stored notes was inputted within a first time threshold of when a previous note of the stored notes was inputted, wherein the previous note and the latest note are categorized as being inputted as part of imitating a strumming performance on a sting instrument in response to determining that the latest note was inputted within the first time threshold of when the previous note was inputted;

sorting the notes in the sound generation buffer according to a pitch order in response to determining that the latest note was inputted within the first time threshold of when the previous note was inputted, wherein the pitch order is set to one of an ascending pitch order of pitches from a low pitch to a high pitch of the notes in the sound generation buffer and a descending pitch order of pitches from the high pitch to the low pitch;

determining sound generation timings at which to generate sounds for the sorted notes in the pitch order;

generating sounds for the sorted notes in the pitch order according to the determined sound generation timings, including generating the sorted notes in the pitch order when the notes stored in the sound generation buffer are not sequentially inputted in the pitch order to imitate a strumming performance played on the string instrument;

determining whether the latest note was inputted within a second time threshold from when the start note was inputted in response to determining that the latest note was not inputted within the first time threshold of when the previous note was inputted;

determining whether the pitch order indicates the descending pitch order in response to determining that the latest note was inputted within the second time threshold from when the start note was inputted;

setting the pitch order to the ascending pitch order in response to determining that the pitch order indicates the descending pitch order;

setting the pitch order to the descending pitch order in response to determining that the pitch order indicates the ascending pitch order; and setting the start note to the latest note in response to determining that the latest note was not inputted within the first time threshold of when the previous note was inputted.

9. The method of claim 8, wherein the notes in the sound generation buffer include a start note, further comprising:

silencing sound generation of the notes after the start note in response to determining that the latest note was inputted within the first time threshold of when the previous note was inputted, wherein the sounds are generated from the sorted notes after the silencing.

10. The method of claim 8, further comprising:

setting the pitch order to the ascending pitch order in response to determining that that the latest note was inputted more than the second time threshold from when the start note was inputted.

11. The method of claim 8, further comprising:

receiving a note-off event for one of the notes in the sound generation buffer;

deleting the note having the note off event from the sound generation buffer; and silencing the generation of any sounds for the note having the note off event.

12. The method of claim 11, wherein the notes in the sound generation buffer include a start note, further comprising:

determining whether the note-off event is for the start note; and resetting the start note in response to determining that the note-off event is for the start note.

13. The method of claim 8, further comprising:

determining a velocity of the latest note; and determining the sound generation timings to generate sounds for the sorted notes as a function of the determined velocity.

14. The method of claim 13, wherein a strumming time decreases as the velocity of the latest note increases.

15. The method of claim 8, further comprising:

determining a strumming time to generate the sounds for the sorted notes; and determining the sound generation timing for an nth note in the pitch order as a function of the strumming time, a last note number in the pitch order, and a value of n.

16. A computer readable device having a control program executed by a processor to access a sound generation buffer and perform operations, the operations comprising:

storing a plurality of notes in the sound generation buffer generated in response to note-on events from a musical instrument, wherein the stored notes correspond to the note-on events to be sound generated and include a start note;

determining whether a latest note of the stored notes was inputted within a first time threshold of when a previous note of the stored notes was inputted, wherein the previous note and the latest note are categorized as being inputted as part of imitating a strumming performance on a sting instrument in response to determining that the latest note was inputted within the first time threshold of when the previous note was inputted;

sorting the notes in the sound generation buffer according to a pitch order in response to determining that the latest note was inputted within the first time threshold of when the previous note was inputted, wherein the pitch order is set to one of an ascending pitch order of pitches from a low pitch to a high pitch of the notes in the sound generation buffer and a descending pitch order of pitches from the high pitch to the low pitch;

determining sound generation timings at which to generate sounds for the sorted notes in the pitch order;

generating sounds for the sorted notes in the pitch order according to the determined sound generation timings, including generating the sorted notes in the pitch order when the notes stored in the sound generation buffer are not sequentially inputted in the pitch order to imitate a strumming performance played on the string instrument;

determining whether the latest note was inputted within a second time threshold from when the start note was inputted in response to determining that the latest note was not inputted within the first time threshold of when the previous note was inputted;

determining whether the pitch order indicates the descending pitch order in response to determining that the latest note was inputted within the second time threshold from when the start note was inputted;

setting the pitch order to the ascending pitch order in response to determining that the pitch order indicates the descending pitch order;

setting the pitch order to the descending pitch order in response to determining that the pitch order indicates the ascending pitch order; and setting the start note to the latest note in response to determining that the latest note was not inputted within the first time threshold of when the previous note was inputted.

17. The computer readable device of claim 16, wherein the notes in the sound generation buffer include a start note, wherein the operations further comprise:

silencing sound generation of notes after the start note in response to determining that the latest note was inputted within the first time threshold of when the previous note was inputted, wherein the sounds are generated from the sorted notes after the silencing.

18. The computer readable device of claim 16, wherein the operations further comprise:

setting the pitch order to the ascending pitch order in response to determining that that the latest note was inputted more than the second time threshold from when the start note was inputted.

19. The computer readable device of claim 16, wherein the operations further comprise:

receiving a note-off event for one of the notes in the sound generation buffer;

deleting the note having the note off event from the sound generation buffer; and silencing the generation of any sounds for the note having the note off event.

20. The computer readable device of claim 19, wherein the notes in the sound generation buffer include a start note, wherein the operations further comprise:

determining whether the note-off event is for the start note; and resetting the start note in response to determining that the note-off event is for the start note.

21. The computer readable device of claim 16, wherein the operations further comprise:

determining a velocity of the latest note; and determining the sound generation timings to generate sounds for the sorted notes as a function of the determined velocity.

22. The computer readable device of claim 21, wherein a strumming time decreases as the velocity of the latest note increases.

23. The computer readable device of claim 16, wherein the operations further comprise:

determining a strumming time to generate the sounds for the sorted notes; and determining the sound generation timing for an nth note in the pitch order as a function of the strumming time, a last note number in the pitch order, and a value of n.

24. An electronic musical instrument, comprising:

a memory including a sound generation buffer;

a processor;

a computer readable device storing a program executed by the processor to perform operations, the operations comprising storing a plurality of notes in the sound generation buffer generated in response to note-on events from a musical instrument, wherein the stored notes correspond to the note-on events to be sound generated and include a start note;

determining whether a latest note of the stored notes was inputted within a first time threshold of when a previous note of the stored notes was inputted, wherein the previous note and the latest note are categorized as being inputted as part of imitating a strumming performance on a sting instrument in response to determining that the latest note was inputted within the first time threshold of when the previous note was inputted;

sorting the notes in the sound generation buffer according to a pitch order in response to determining that the latest note was inputted within the first time threshold of when the previous note was inputted, wherein the pitch order is set to one of an ascending pitch order of pitches from a low pitch to a high pitch of the notes in the sound generation buffer and a descending pitch order of pitches from the high pitch to the low pitch;

determining sound generation timings at which to generate sounds for the sorted notes in the pitch order;

generating sounds for the sorted notes in the pitch order according to the determined sound generation timings, including generating the sorted notes in the pitch order when the notes stored in the sound generation buffer are not sequentially inputted in the pitch order to imitate a strumming performance played on the string instrument;

determining whether the latest note was inputted within a second time threshold from when the start note was inputted in response to determining that the latest note was not inputted within the first time threshold of when the previous note was inputted;

determining whether the pitch order indicates the descending pitch order in response to determining that the latest note was inputted within the second time threshold from when the start note was inputted;

setting the pitch order to the ascending pitch order in response to determining that the pitch order indicates the descending pitch order;

setting the pitch order to the descending pitch order in response to determining that the pitch order indicates the ascending pitch order; and setting the start note to the latest note in response to determining that the latest note was not inputted within the first time threshold of when the previous note was inputted.

25. The electronic musical instrument of claim 24, wherein the notes in the sound generation buffer include a start note, wherein the operations further comprise:

silencing sound generation of notes after the start note in response to determining that the latest note was inputted within the first time threshold of when the previous note was inputted, wherein the sounds are generated from the sorted notes after the silencing.

26. The electronic musical instrument of claim 24, wherein the operations further comprise:

setting the pitch order to the ascending pitch order in response to determining that that the latest note was inputted more than the second time threshold from when the start note was inputted.

27. The electronic musical instrument of claim 24, wherein the operations further comprise:

receiving a note-off event for one of the notes in the sound generation buffer;

deleting the note having the note off event from the sound generation buffer; and silencing the generation of any sounds for the note having the note off event.

28. The electronic musical instrument of claim 27, wherein the notes in the sound generation buffer include a start note, wherein the operations further comprise:

determining whether the note-off event is for the start note; and resetting the start note in response to determining that the note-off event is for the start note.

29. The electronic musical instrument of claim 24, wherein the operations further comprise:

determining a velocity of the latest note; and determining the sound generation timings to generate sounds for the sorted notes as a function of the determined velocity.

30. The electronic musical instrument of claim 29, wherein a strumming time decreases as the velocity of the latest note increases.

31. The electronic musical instrument of claim 24, wherein the operations further comprise:

determining a strumming time to generate the sounds for the sorted notes;

determining the sound generation timing for an nth note in the pitch order as a function of the strumming time, a last note number in the pitch order, and a value of n.

32. The electronic musical instrument of claim 24 comprising a sound source module configured to be detachably connected to an electronic keyboard.

* * * * *